United States Patent [19]

Franco

[11] Patent Number: 4,655,863

[45] Date of Patent: Apr. 7, 1987

[54] LOOM FOR CARPETS, TAPESTRY, AND THE LIKE AND METHOD OF USING

[76] Inventor: Miguel V. Franco, P.O. Box 99, Sunol, Calif. 94586

[21] Appl. No.: 828,834

[22] Filed: Feb. 12, 1986

[51] Int. Cl.[4] ..... D04H 11/00

[52] U.S. Cl. ..... 156/72; 156/435

[58] Field of Search ..... 156/72, 435, 174, 426, 156/178, 177; 112/80.01, 80.3; 139/8, 11, 13 R

[56] References Cited

U.S. PATENT DOCUMENTS

| | | | |
|---|---|---|---|
| 1,970,625 | 8/1934 | Reed | 156/435 |
| 3,266,969 | 8/1966 | Makansi | 156/72 |
| 3,736,209 | 5/1973 | Carpenter | 156/435 |
| 3,937,643 | 2/1976 | Spanel | 156/435 |
| 4,028,157 | 6/1977 | Abel | 156/435 |
| 4,411,722 | 10/1983 | Yazaua et al. | 156/177 |
| 4,413,658 | 11/1983 | Vilargunte | 139/13 R |
| 4,502,902 | 3/1985 | Zürcher | 156/435 |
| 4,576,665 | 3/1986 | Machell | 156/72 |

FOREIGN PATENT DOCUMENTS

| | | | |
|---|---|---|---|
| 702460 | 1/1954 | United Kingdom | 156/435 |

*Primary Examiner*—Michael Ball

*Attorney, Agent, or Firm*—Owen, Wickersham & Erickson

[57] ABSTRACT

A power loom for making carpets, tapestry and the like. A stationary, cylindrical mandrel is surrounded by a rotatable annular table adjacent the mandrel's upper end. The table is rotated around the mandrel. Each strand of yarn is guided down vertically between the mandrel and the annular table. A continuous circumferential series of substantially identical loom stations is mounted in succession on the annular table, each station having a pressure blade assembly, a guiding hook, and a cutter assembly. A jute is fed in split cylindrical form downwardly around and with an inner surface against the mandrel. The jute having an adhesively coated outer surface. Each hook engages a series of successive strands passing down, and at each loom station, feeds them one at a time to a pressure blade assembly while the annular table rotates. Each pressure blade assembly includes pressure means for forcing each strand against the coated jute and adhering it there to the jute's outer surface. Each cutter assembly acts to sever each strand at a desired pile height.

34 Claims, 19 Drawing Figures

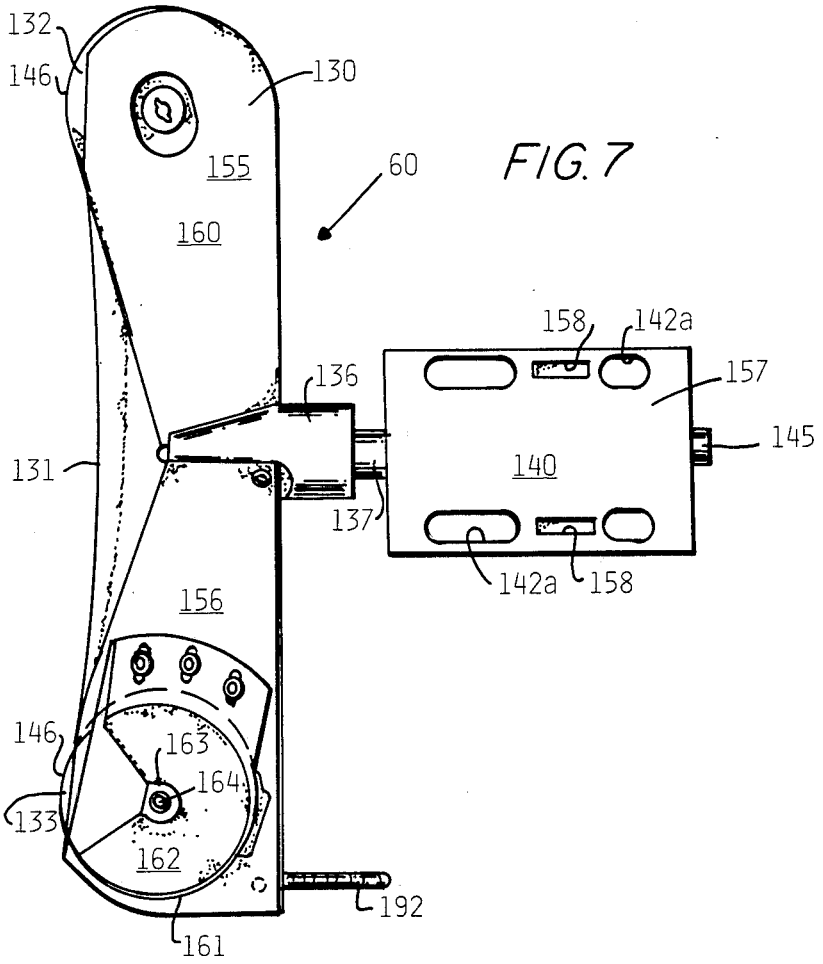
FIG. 7
FIG. 12
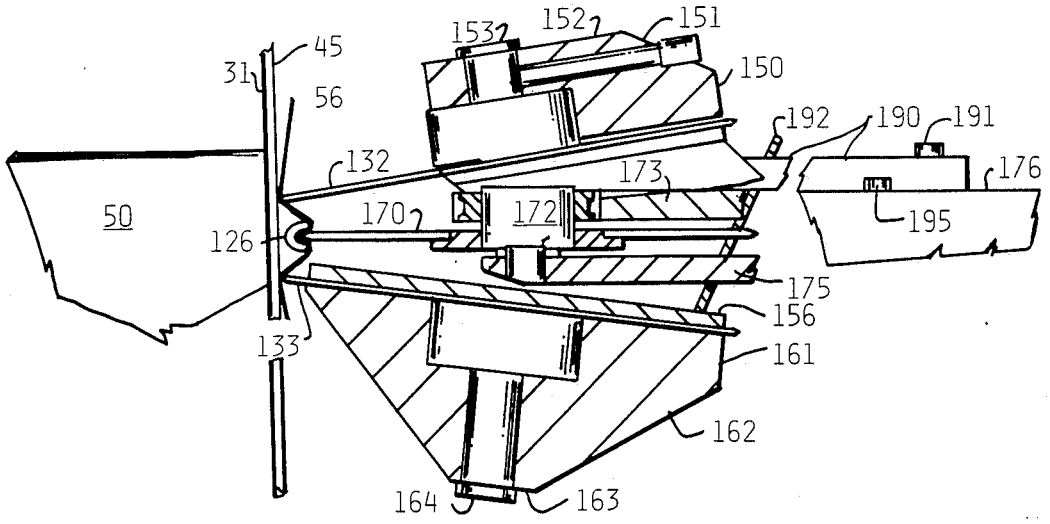

LOOM FOR CARPETS, TAPESTRY, AND THE LIKE AND METHOD OF USING

This invention relates to an improved loom for carpets, tapestry and the like and to a method for making them. The loom is in a cylindrical form, instead of the traditional wide horizontal form of other carpet looms, such as a Jacquard loom or a broadloom.

BACKGROUND OF THE INVENTION

Jacquard looms and broadlooms are well known. They have many moving parts, resulting in many wearing parts. They require many people to operate each machine, and require considerable power in operation.

An object of the invention is to provide a loom which is very sturdy, strong and practically breakdown free.

Another object is to provide a carpet loom that operates much faster than prior-art looms and so can produce a greater volume of carpeting than prior-art looms. When compared to the "Jacquard loom", the new loom is at least ten times faster, and the product is of equal or better appearance.

Another object of the invention is to provide a loom with greater versatility, having the ability to produce a variety of types and designs of carpeting.

Another object is to provide a loom with the capability of making wall-coverings, tapestries, and curtains, any of which can provide a unique design pattern.

In comparison with the Jacquard loom, the loom of this invention is more dependable, sturdier, and stronger. It offers minimum down time, is faster and can produce up to ten times more carpeting in the same time, and produces carpetry and other products of the highest quality and best appearance. Its products are equal to or better to those of the Jacquard loom, and enables more variety of types and designs. Furthermore, changes in pile height and density can be made while the device is in operation, using computer control through solenoids or similar apparatus.

The loom of this invention, when compared to the broadloom (which is the fastest loom heretofore made), has many advantages. It is as fast as the broadloom and it can produce as much product per unit time as the broadloom; however, it does this at a much lower cost.

An important determining factor is the efficiency, output, and final cost of finished product, not simply the speed of the machinery.

While cost of material is about the same for both types of machines, the labor cost is very different. For example, each broadloom typically, requires nine persons, from start to finish, on its production line, whereas the loom of this invention requires only three persons for its complete production line, a savings of over 60% in labor.

It is known that a broadloom makes only a small variety of weaves, usually the solid, high-low, shags, and diamond types; whereas the loom of the present invention can make not only the solids, high-lows, shags, and diamond types, but also more intricate designs and weaves, including but not limited to those above. It can make various weights, textures, and designs of carpets, tapestry, curtain cloth, and wall coverings.

The loom of this invention also has the advantage of being much more sturdy, being inherently made to give low maintenance costs, and is almost breakdown-free. This, of course, reduces costs, because the loom can operate on a twenty-four hour continuous basis, longer than any of the comparable prior-art looms.

The invention has been designed to reduce breakdowns by having far fewer moving parts than prior-art looms of this type—actually about 75% fewer moving parts. Therefore, the loom of the present invention is more efficient, less costly and more productive than earlier looms.

In summary, the loom of the present invention, when compared to the broadloom, is superior overall, especially when considering the following points:

A. It is sturdier, stronger and more dependable, because of its design and construction.

B. It has a more efficient and productive capacity because it breaks down less often and it produces more carpeting; also its production line is less complicated.

C. Its carpet is of an equal or better quality in its appearance.

D. Its variety of the types designs and lengths of products, is much superior to prior-art looms, for it can match and surpass both the Jacquard and broadloom devices.

E. These new looms are in all cases, more economical than prior-art looms, the greatest savings resulting from savings in labor costs, maintenance costs, and downtime.

For example, the labor savings is expected to be at least 60%. Moreover, since the machine is constructed of sturdy material and has fewer moving parts, the maintenance required is less than 80% than that for prior-art looms of comparable capabilities. Further the new loom has the advantage that because of its design and construction, especially its fewer moving parts and its strong material construction, the wear is minimal. Parts that do wear can be readily available, and replacement can be made in minutes, not hours or days. It is therefore realistic to predict that the "down-time" of this new loom, will be, at a maximum, about 5% of its competition, or 95% less than its competitors.

SUMMARY OF THE INVENTION

The invention provides a power loom for making carpets, tapestry and the like, when fed by suitable strands of yarn. It has a stationary, cylindrical mandrel supported on a base and provided with a cylindrical outer surface.

A rotatable annular table surrounds and is adjacent to said mandrel's upper end, and a drive system rotates the annular table around the mandrel. A Guide ring guides each strand of yarn down vertically to the space between the mandrel and the annular table.

The table carries a continuous circumferential series of substantially identical loom stations mounted in succession on the annular table, each station having a pressure plate assembly, a guiding hook, and a cutter assembly.

Meanwhile, the jute is fed in split cylindrical form downwardly around and with an inner surface against the mandrel. The jute has an adhesively coated outer surface.

At each station, each hook engages a plurality of successive strands passing down from the yarn-guide ring and feeds them one at a time to its pressure blade assembly as the annular assembly rotates. The pressure blade assembly forces each strand against the jute and adheres it there to the tacky outer surface of the jute. Then the cutter assembly cuts off the strand at a desired pile height, all as the annular assembly rotates.

More specifically, the power loom has a stationary main frame which supports the stationary, cylindrical mandrel and also supports an intermediate cylindrical ring with a ring gear around its outer surface. A rotatable annular table is supported for free rotation by the main frame and surrounding and adjacent to the mandrel's upper end. The table has a flat annular upper surface with inner and outer circular edges. An inner depending sleeve extends down from the table's circular inner edge and has a lower edge, and a radially outer surface.

A series of horizontally mounted rollers are supported for free rotation by the main frame; these are engaged by the lower edge of the sleeve, to support the table for free rotation. A series of vertically mounted rollers is supported for free rotation by the main frame in engagement with the outer edge of the table to guide the table when it rotates.

A motor has a drive shaft with a first gear thereon, and a vertical main shaft has second, third, and fourth gears thereon. A chain connects the first and second gears so that the motor drives the main shaft. A friction band engages the third gear, which is at the upper end of the vertical main shaft; this friction band is in firm driving contact with the radially outer surface of the sleeve, so as to drive the table.

A stationary, upper, yarn-guide ring is supported by the main frame and is spaced above the annular table. It has a multiplicity of guide openings therethrough for guiding each strand of yarn down vertically to the space between the mandrel and the intermediate ring.

A continuous circumferential series of loom stations is mounted in succession on the table, each station having a pressure blade assembly, a guiding hook, and a cutter assembly.

Each pressure blade assembly has a sector generally parallel to the mandrel, with an upper disc at one end and a lower disc at the other end. The pressure blade assemblies overlap to provide at each station a vertically spaced-apart pair of freely rotatable undriven serrated discs, namely a upper disc on one pressure plate assembly and a lower disc on another overlapped pressure plate assembly. Each disc engages each strand, one by one.

Between each vertically spaced-apart pair of discs, a cutter assembly provides a sharp cutting blade (rotated by a drive train, that is driven by the ring gear) to cut off the thread at a point midway between the pressure blade discs, thereby leaving two lengths forming a pile thread. The hooks engage the strands before they are cut and guide them to the discs and to the cutting blade.

BRIEF DESCRIPTION OF THE DRAWINGS

FIG. 7 is a bottom view of a pressure blade assembly looking in the direction of the arrows 7—7 in FIG. 6.

FIG. 12 (on the same sheet as FIG. 7) is a view in section taken along the line 12—12 in FIG. 11.

DESCRIPTION OF A PREFERRED EMBODIMENT

Figure 1:
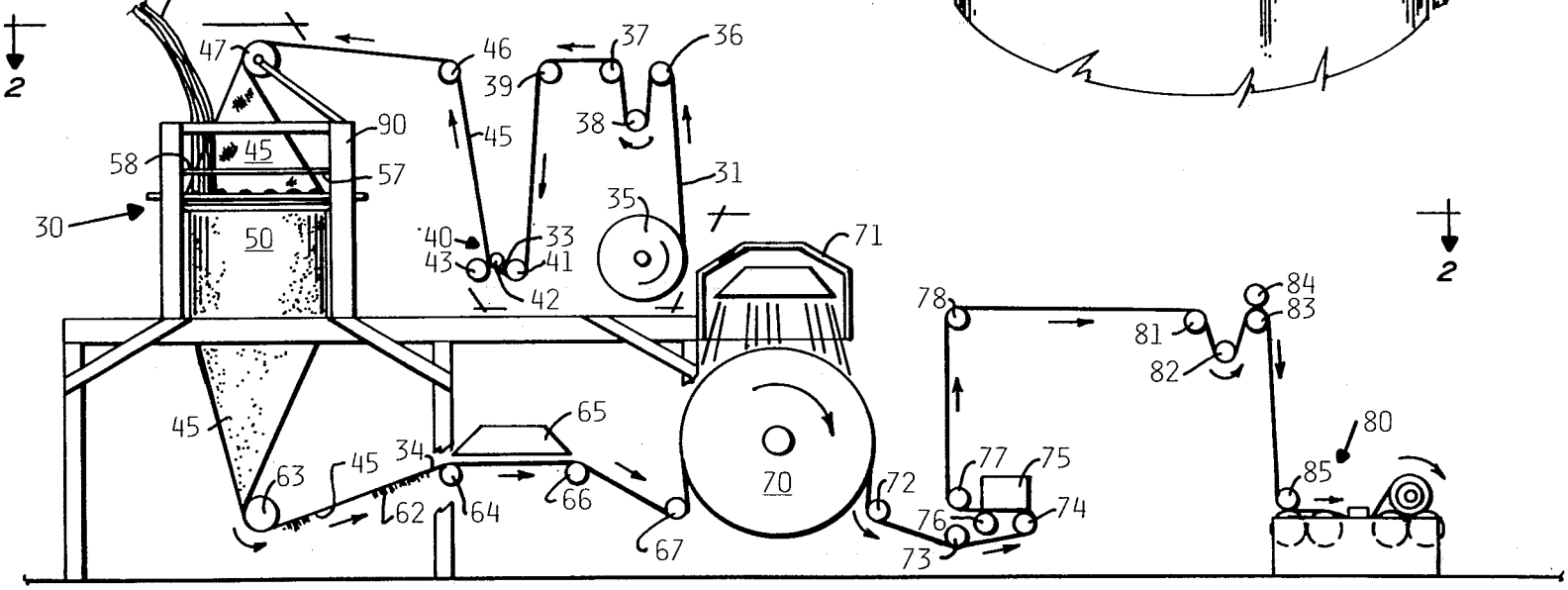
FIG. 1 is a simplified and partly diagrammatic view in side elevation of an assembly embodying the principles of the present invention and comprising the novel loom of this invention with the accompanying feeding of the jute and yarn and delivery of the pile fabric.
Figure 2:
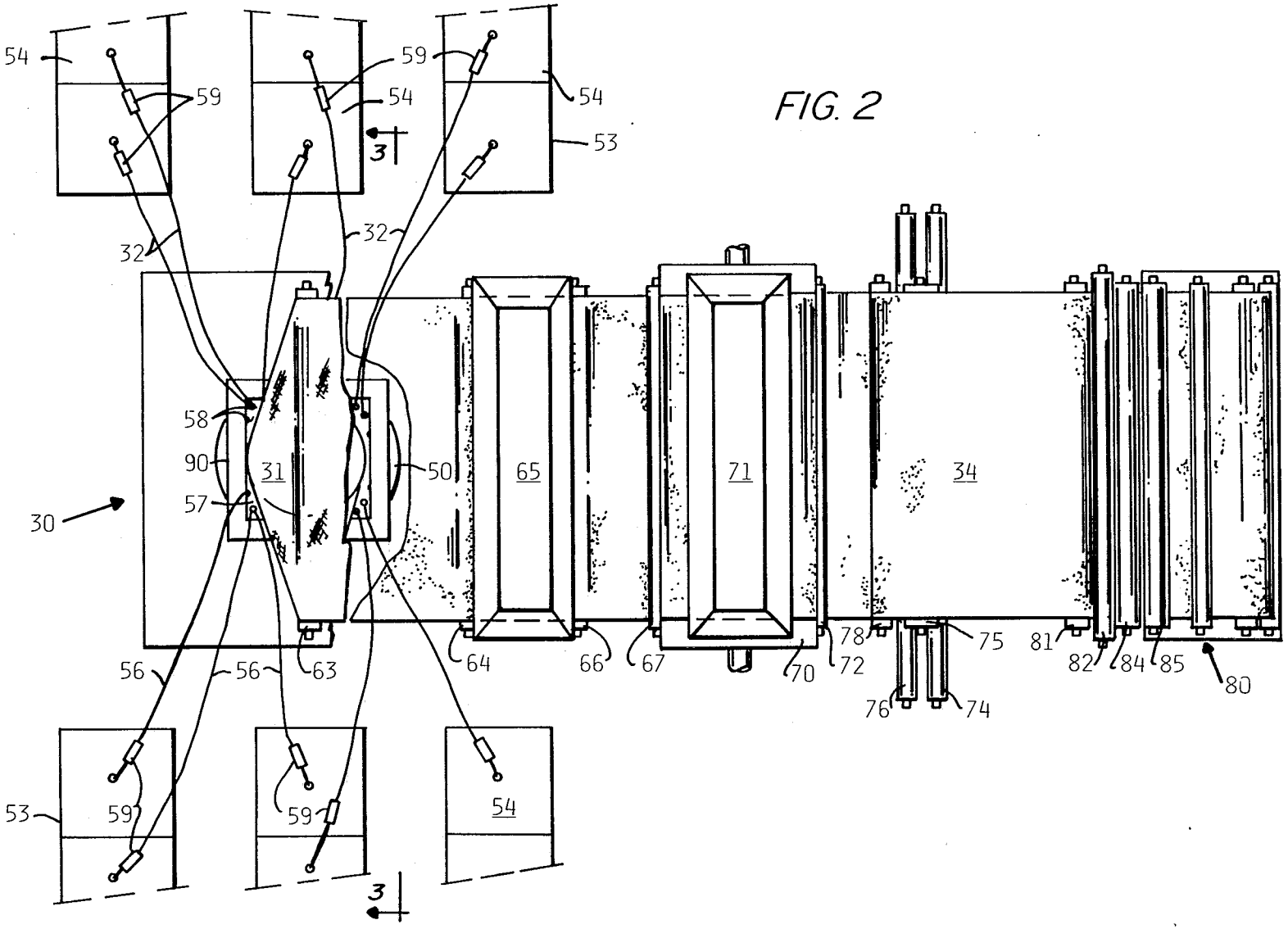
FIG. 2 is a top plan view of the device shown in FIG. 1, a few of the parts, especially upper parts, being omitted for the sake of clarity.
Figure 3:
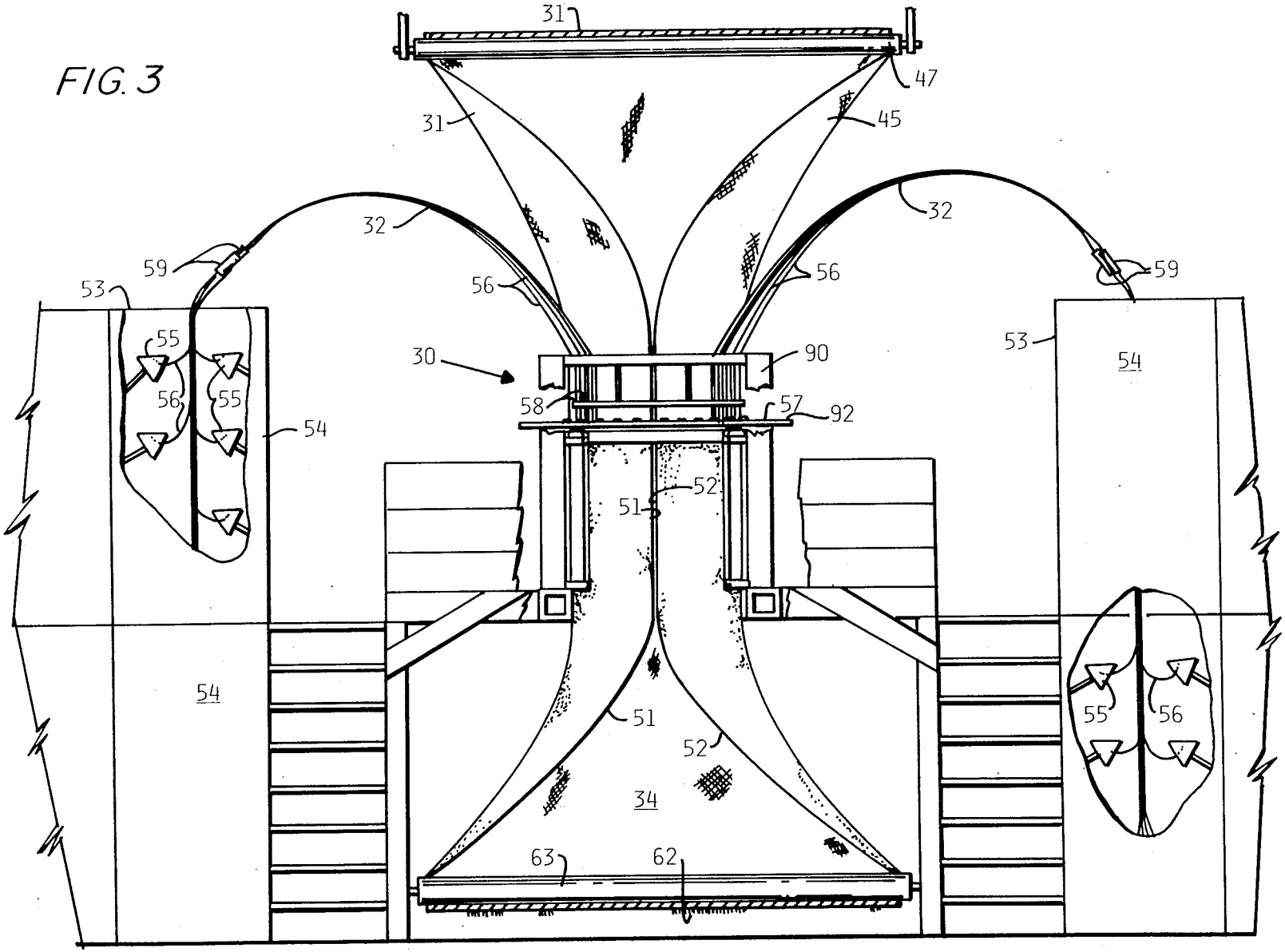
FIG. 3 is a view in elevation of the loom itself and some accompanying apparatus, showing the feeding in of the jute and the yarn, and the feeding out of the pile fabric.

The General Assembly (FIGS. 1-3)

As FIGS. 1 to 3 show, the invention comprises a novel loom 30 together with apparatus for supplying to it a jute 31, yarn 32, and adhesive 33 and apparatus for delivering from the loom 30 a pile fabric 34 that is provided by the loom 30.

As shown in FIG. 1, the jute 31 (or primary or base) may be fed continuously from a roller 35 up to a set of feed rollers 36 and 37 with a pressure roller 38 between them and on to a direction changing feed roller 39. The jute 31 then passes down to an adhesive applying station 40 with guiding rollers 41 and 42 and a pressure roller 43. Here, polyvinyl chloride or other suitable adhesive 33 is applied to one face 45 of the jute 31. The jute 31 then passes up to a roller 46 and from there to a roller 47 directly above the loom 30. All this time, the jute 31, has been a continuous and generally flat sheet. From the roller 47, the jute 31 is supplied to the loom 30 as a continuous nearly cylindrical sheet nearly encircling a circular cylindrical mandrel 50 of the loom 30. The jute's side edges 51 and 52 (FIG. 3) do not quite meet but are close together, and otherwise the jute 31 is then cylindrical.

As shown in FIGS. 2 and 3, there are also assemblies 53 of creels 54 which provide the strands of yarn 32 to the loom 30. There may be thirty-six creels 54, for example, with eighteen on each side, some of which are shown in FIGS. 2 and 3. Each creel 54 has a series of creel cones 55 (FIG. 3) and each cone 55 is wound around with a strand 56 of yarn 32. The strands 56 are fed from the creels 54 to an annular perforate plate 57, each yarn strand 56 going through an opening 58 through the perforate plate 57. There may be from about 500 to 1500 openings 58 and strands 56. Thus, if there are thirty-six creels 54 and if each creel 54 has twenty cones 55, there are 720 individual threads of yarn, and the perforated plate 57 will have 720 openings 58, preferably arranged in staggered fashion but going almost all the way around the loom 30. Other plates 57 with more or fewer openings may be used, or some openings 58 may be skipped or provided with two strands 56 per opening. The purpose here is to control the path of each strand 56 of yarn 32 so that it will flow to the loom 30 generally vertically, approximately parallel to the axis of the mandrel 50. In order to keep the strands 56 clean and undamaged, each strand 56 is preferably conducted from its cone 55 to the perforate plate 57 through a flexible tube 59. The tubes 59 also prevents the strands 56 from becoming entangled with each other.

As both the yarn strands 56 and the jute 31 move down, they come to the main working area of the loom 30. This will be described in detail later, but for the present it may be said that a series of pressure blade assemblies 60 (FIG. 4) is provided, along with a corresponding series of cutting assemblies 61. The loom 30, being supplied with both the yarn strands 56 and the jute 31, the two assemblies 60 and 61 are combined in order to place short lengths of yarn 32 onto the adhesively coated jute surface 45 and anchor a center portion there by virtue of the adhesive, as will be explained below in connection with FIGS. 15–17.

Figure 17:
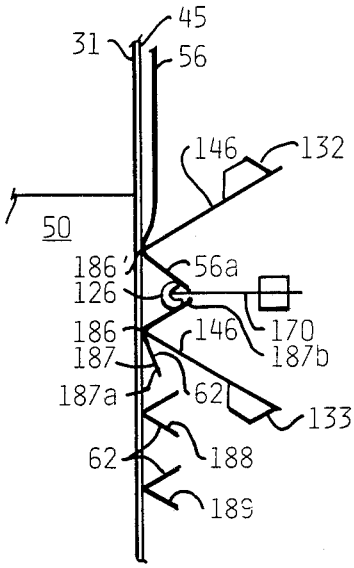
FIG. 17 is a similar view of the moment of cutting the strand to produce the pile fabric in accordance with the device.
Figure 15:
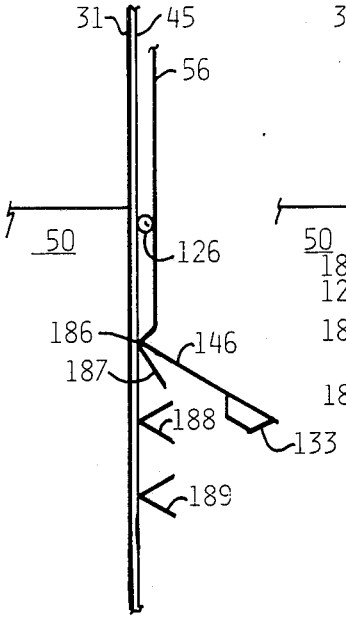
FIG. 15 is a simplified and partly diagrammatic views showing a strand being caught by a pressure plate and urged against the jute.
Figure 16:
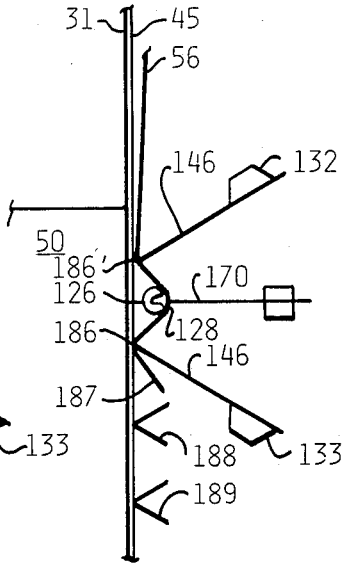
FIG. 16 is a similar view at a moment later.

Each individual pile strand 62 is adhered to the jute surface 45 at its approximate center, and the cutter assembly 61 cuts it to the approximate length needed. (FIGS. 15–17 show this diagrammatically.) How this is done is the principal matter to be described later in the application.

From here (FIGS. 1 and 3), the pile-covered jute 31 goes to the bottom of the mandrel 50 and below it where it is unfolded into a continuous generally sheet-like product 34. This product 34 is then guided by a roller 63 to a roller 64 (FIGS. 1 and 2) at an entrance to a sprayer station 65. Here, additional cement may, if needed, be added on the opposite side of the jute 31 from the surface 45 to which the pile fabric 62 is attached. At the exit from the sprayer station 65, another roller 66 sends the fabric 62 to a direction-changing roller 67 that applies the sheet to a drum 70. The drum 70 carries the pile-coated sheet 34 beneath a set of heaters 71, where all adhesive is heated and dried to make permanent the affixation of the yarn pile 62 to the jute 31. From the other side of the drum 70, a guide roller 72 leads to rollers 73 and 74 which introduce the jute 31 to a shear device 75. The shear device 75 cuts off the pile 62 at a uniform height, this uniformity being best achieved after all the work up to that stage has been completed. From the shear device 75 the jute goes by roller 76, 77 and 78 to a cut-off station 80, with an introducing roller 81 and stretching rollers 82, 83, 84 and 85, just beyond which lengths of completed carpeting are cut off. At this point the carpeting is ready to be shipped without further processing.

The rollers and other moving parts may be synchronized by chains on other well known synchronized devices.

The loom 30 in general

The loom 30 comprises the cylindrical mandrel 50 which is supported by a cross frame 90 (FIGS. 1–3) and which remains stationary at all times. The mandrel 50 is elevated, and the jute 31, which has been formed into a cylindrical shape moves down axially of the mandrel 50 and then at the lower end of the mandrel 50 is spread out again to form a pile-coated sheet 34. The frame 90 supports the perforated plate 57 through which the yarn 32 is fed in several hundred strands 56. There, the strands 56 come down generally vertically close to the jute surface 45 and to the mandrel 50 but without touching either one of them.

At the operative part of the loom 30, is a rotating annular table 91, preferably rotating at a rate of several times per minute, which surrounds the mandrel 50, the top surface 92 being adjacent to the upper end 93 of the mandrel 50. The frame 90 holds intermediate non-rotating cylinder 94 (FIGS. 4, 13 and 14), which is spaced between the table 91, and the mandrel 50. This cylinder 94 has a toothed ring gear 95 attached to its outer surface. The ring gear 95 meshes with gears 183 (FIGS. 10, 11, 13 and 14), of the cutter blade assemblies 61, which are attached to the top surface 92 of the table 91. The purpose of this will become apparent later.

Figure 14:
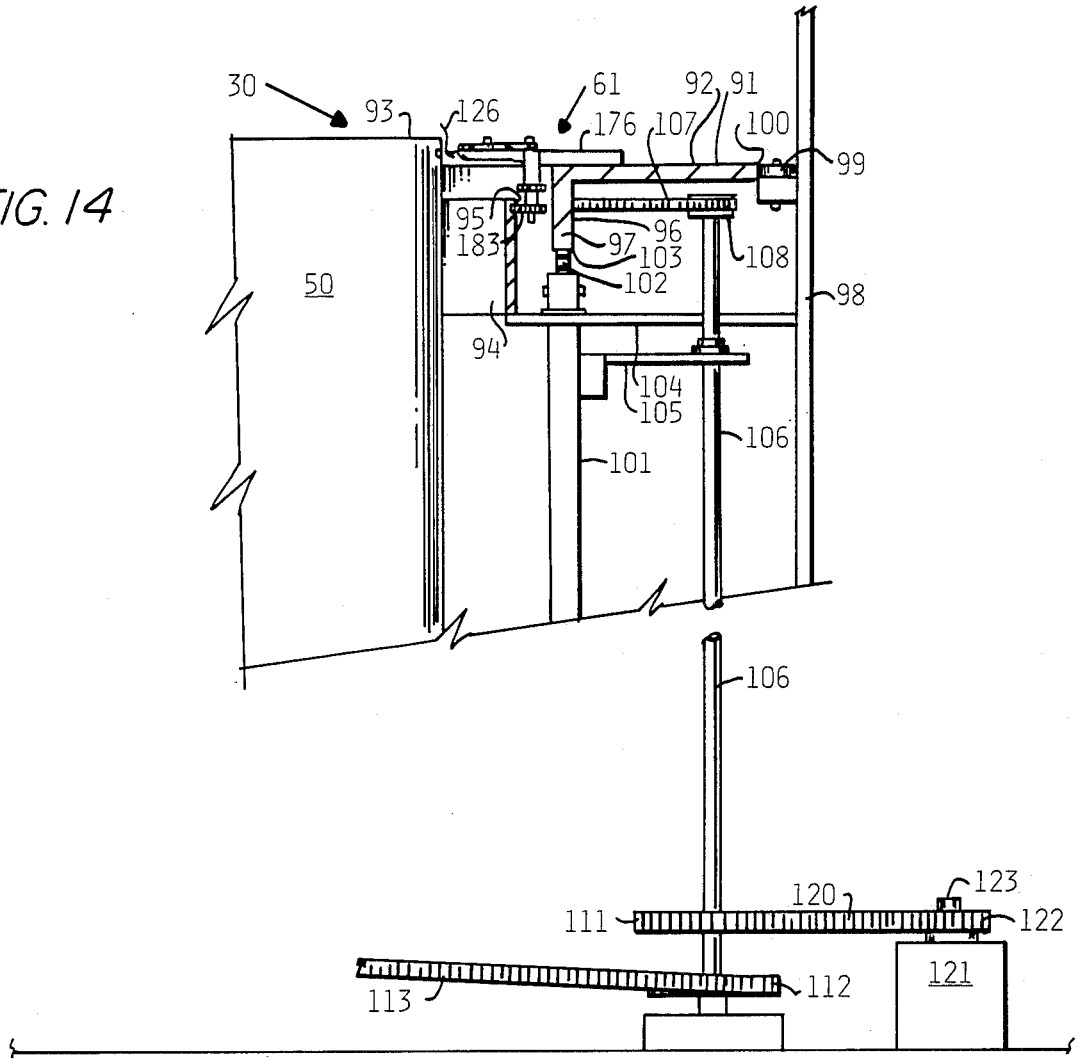
FIG. 14 is a fragmentary view in elevation taken along the line 14—14 in FIG. 13.

The driving mechanism (FIGS. 12 and 14)

The table 91, in addition to its flat upper surface 92, has a downwardly extending annular sleeve 97 (FIG. 14). The frame 90, has a series of posts 98, to each of which a vertically mounted roller 99, is attached. An edge 100 of the assembly 91 engages the rollers 98 which guides the rotation of the table 91. Another series of posts 101, spaced closer to the non-rotating support 94, has horizontally mounted rollers 102, on which a lower edge surface 103 of the sleeve 97 rests, to support the table 91 for free rotation. A series of horizontal bars 104 extend inwardly from the posts 98 and serve as a brace for the support 94.

A bracket 105, attached to one of the posts 101 (FIGS. 13 and 14), has a bearing through which a shaft 106 extends. A friction band 107 engages a gear 108, which is mounted on the top end of the shaft 106. The band 107 surrounds the portion 97 of the table 91 engages its radially outer surface 96 snugly and thereby rotates the table 91.

As shown in FIG. 14, the bottom end of the shaft 106, which extends some eight feet below the bottom plane of the mandrel 50, has two gears 111 and 112 mounted thereon. The gear 112 is connected by a chain 113 to a gear 114 (See FIG. 13) which drives a gear 114. The gear 114 is in a shaft **114*a* which also is secured to a gear 115, which in turn is connected by a chain 116 to another gear 117 that drives the roller 63. By varying the speed of the roller 63 or by varying its pressure against the pile fabric 45** the number (or rate) of the stitches per inch can be varied.

Figure 13:
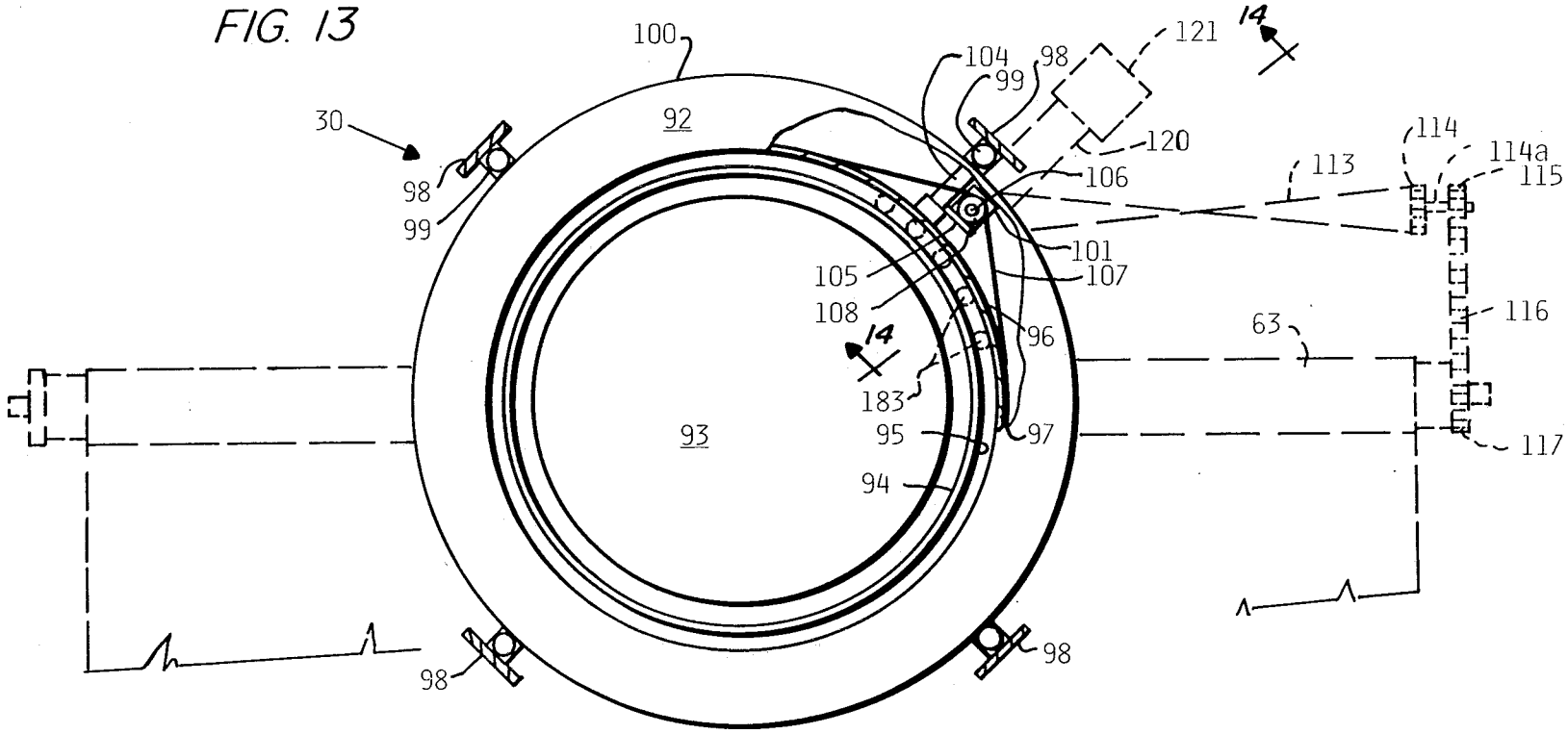
FIG. 13 is a top plan view of the loom portion of the assembly shown in FIG. 1, a few of the parts being omitted for the sake of clarity, showing the power drive system.

The gear 111, leads by a chain 120 to gear 122 mounted on a drive shaft 123 of a motor 121 (FIGS. 13 and 14). The motor 121, through the interconnection of gears, chains and the shaft 106, provides the sole source of power for all the rotating pieces of the loom 30, including the roller 63 and the table 91, except for the rotating elements of the assemblies 60 and 61, which will be described below. The motor 121 also synchronizes the timing of the operation.

Figure 4:
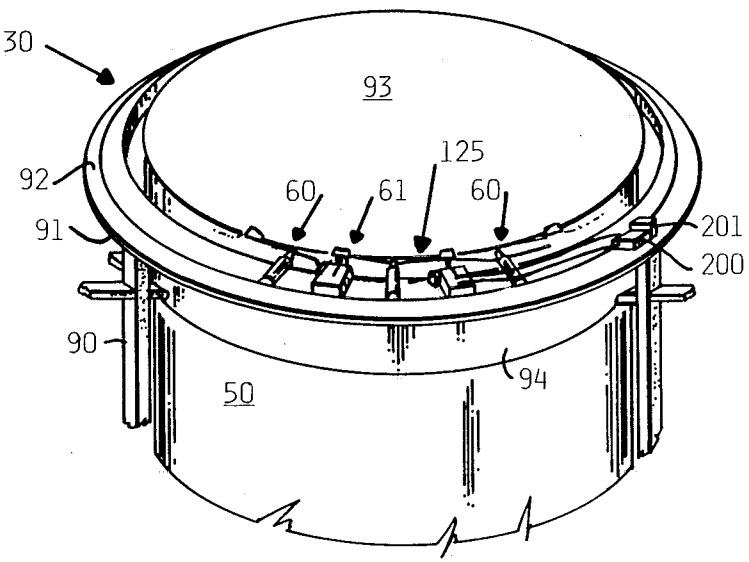
FIG. 4 is a fragmentary view in perspective of the operative portion of the loom at which the yarn is affixed to the jute. Only a few of the identical loom stations are shown and the rest omitted as repetitive.

The upper flat portion 92 of the annular table 91 is used in conjunction with a series of substantially identical sub-assemblies related to each other that may be termed loom stations 125. FIG. 4 illustrates this, as does FIG. 11, but although some of the loom stations 125 are omitted from these views, they continue all around the table 91. For example, there may be sixteen of these loom stations 125 around the table 91, and they may be all identical. They are mounted in succession at a constant distance apart, and each station 125 includes a pressure blade assembly 60, a guiding hook 126, and a cuter assembly 61.

The Pressure Blade Assemblies 60 (FIGS. 5-7, 11 and 12)

Figure 5:
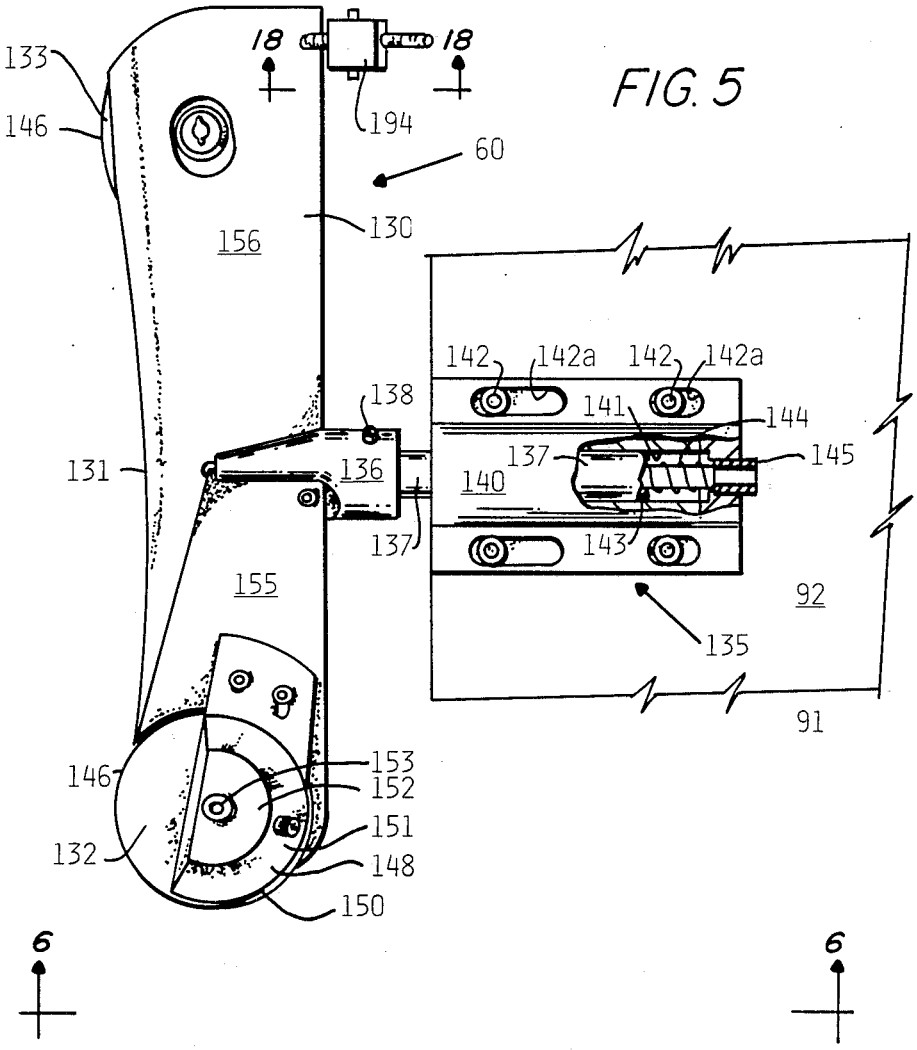
FIG. 5 is a top plan view of one of the pressure blade assemblies shown in FIG. 4 with a portion being shown in section. Only a portion of the annular table is shown.
Figure 11:
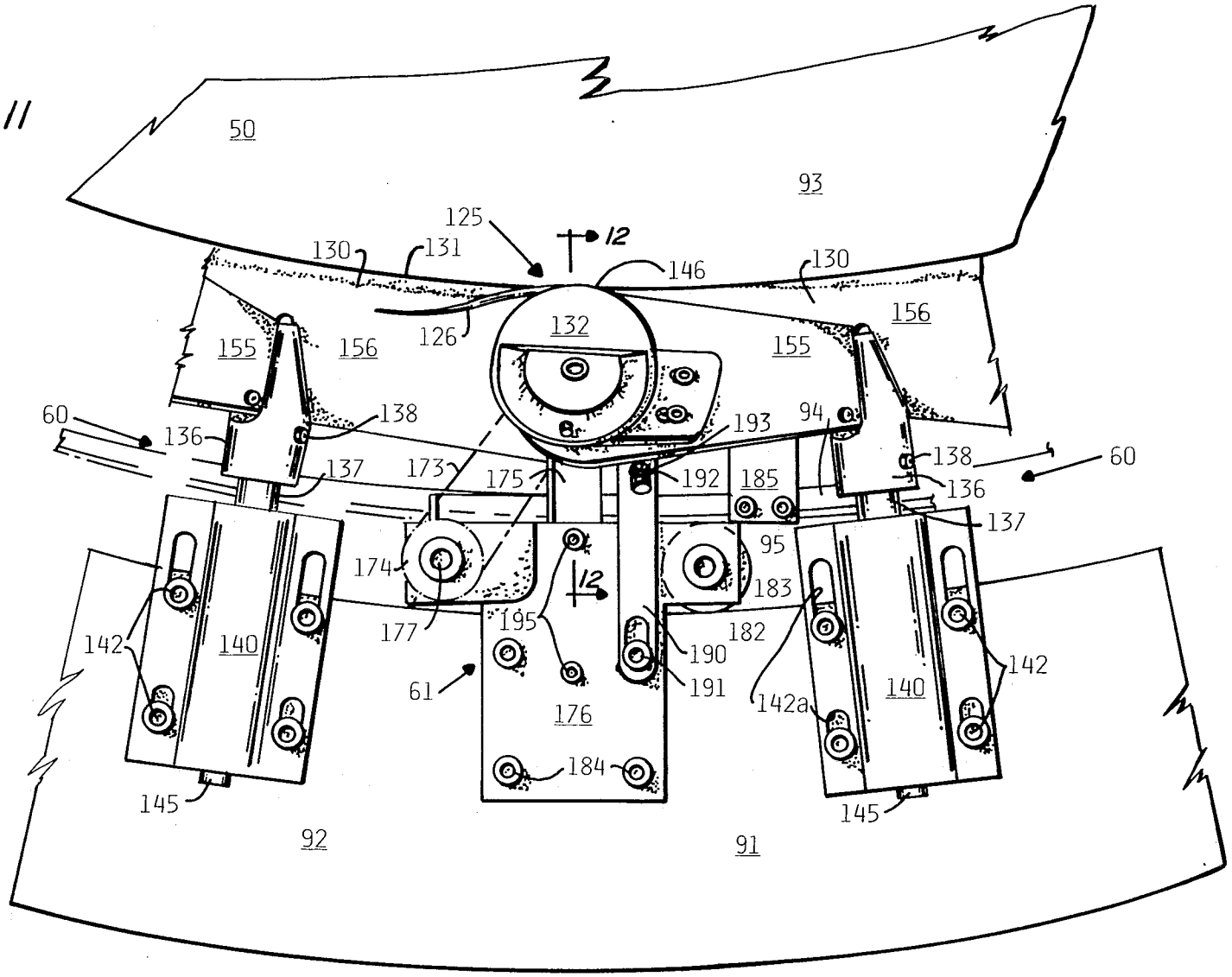
FIG. 11 is a fragmentary top plan view of a portion of FIG. 4.

Each pressure blade assembly 60, as shown in FIGS. 5 and 7, includes an elongated main supporting member 130, one face 131 of which has an arcuate edge corresponding generally to the radius and arc of the mandrel 50, which it closely approaches. At one end this member 130 includes the support for an upper pressure blade 132 and at the opposite end it includes a support for a lower pressure blade 133. Secured to the center of the member 130 and extending outwardly therefrom is a support device 135 which includes a supporting head 136. The head 136 is attached, preferably adjustably but nevertheless rigidly, to the main support 130, and a shaft 137 which is held by set screws 138 to the assembly 130, extends out and into a main support member 140. Thus, the main support member 140 holds the shaft 137, which in turn supports the pressure blade assembly 60. The shaft 137 extends into a cylindrical opening 141 (FIGS. 5-7) which is held to the table's upper surface 92 by a series of fasteners 142 extending through slots 142*a*, as shown in FIG. 11. The opening 141 is provided at its radially outer end with a circular plate 143 that engages one end of a spring 144, the other end of which engages the end of a cylindrical tube 145 spaced away therefrom to provide the needed resilience. Compressed air may be introduced through the tube 145 to compress the spring 144 and move the shaft 137 outwardly. Adjustability is also provided. The shaft 137 is so rotated that upper blade 132 is inclined upwardly at about 4° and the lower blade is inclined downwardly at 4°. The purpose for the 4° angle is that the sixteen stations 125, when placed one-eight of an inch apart, then will give two inches vertical travel of the jute 31 per rotation of the table 92.

The upper pressure blade 132 comprises a disc blade, preferably with a serrated edge 146 to help grasp and hold the yarn and prevent it from slipping back out, which is used to apply pressure but does not cut anything, and this blade 132 is mounted for free rotation between a lower block 147 (FIG. 6) and an upper block 148. The upper block 148 is slightly larger than a semicircle, and it has a cylindrical outer rim 150 followed by a frustoconical portion 151 leading to a flat upper portion 152. The block 148 is cut off, in effect, to expose about 150° of the pressure blade 132. Nuts 152 enable adjustability here. It will be noted from the drawings that the assembly 60 itself is somewhat sloped and that the plane of the upper pressure blade 132 is sloped relative to the plane of the axis of the shaft 137 as well as that of the generally flat, but warped, holder 130. The holder 130 (FIGS. 5 and 7) is in effect treated as two oppositely sloping members 155 and 156 with a kind of warping in between them to provide their angled surfaces.

To the lower surface 160 (FIG. 7) of this holder 131 the lower pressure blade 133 is mounted for free rotation. The blade 133 is similar to the upper pressure blade 132 so far as the disc portion is concerned but may have more coverage therearound, with a cylindrical rim 161 (FIGS. 6 and 12) and an almost conical lower end 162 and a small top portion 163, through which an adjustment screws 164 is provided. The plane of the blade 133 is sloped in the opposite direction from that of the blade 132.

Figure 6:
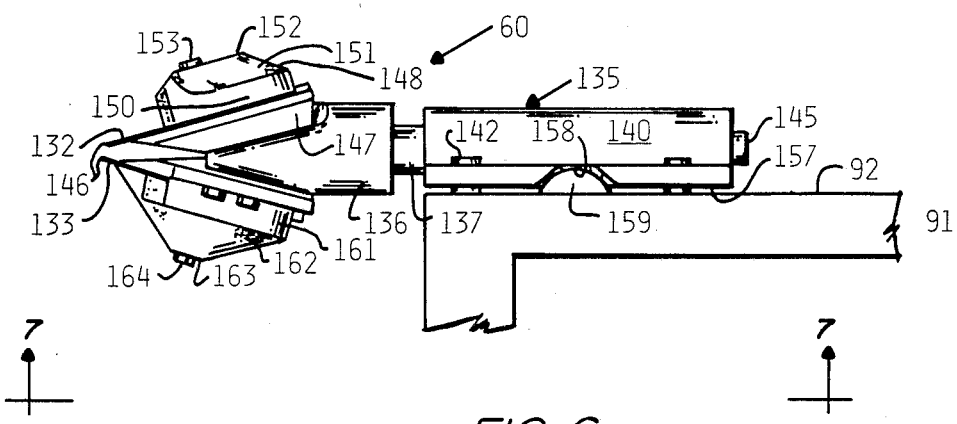
FIG. 6 is a view in side elevation of a pressure blade assembly looking in the direction of the arrows 6—6 in FIG. 5, but with an half-moon adjustment member shown in section.

The pressure blade assemblies 60 are overlapped together, so that the lower pressure blade 133 on one assembly 60 is directly opposite the upper pressure blade 132 of the next assembly 60, and this continues all the way around the loom 30. The pressure blades 132 and 133 slope toward each other, as shown in FIG. 6, but do not touch and are properly spaced apart. The blades 132 and 133 are freely rotatable but are not power driven; they do not resist rotation when they come against the strands 56 or even bear directly or indirectly on the jute 31.

To overcome irregularities due to manufacturing tolerances on the bottom surface 157 (FIGS. 6 and 7) of the main support member 140 or on the upper surface 92 of the table 91, and to achieve the correct alignment of the pressure blade assemblies 60 relative to the hooks 126, it is necessary to make it possible to tilt the assemblies 60 relative to the table 91. To do this the member 140 has a pair of semicylindrical recesses 158 in which fit a corresponding pair of half-moon keys 159 that project a little from the recess 158 and bear on the surface 92. The screws 142 may be tightened differentially; the radially outer screws 142 tend to swing the pressure blades 132 and 133 up, and the radially inner screws 142 tend to swing the pressure blades 132 and 133 down, relative to the table surface 91.

The cutter assembly 61 (FIGS. 9-12)

Figure 8:
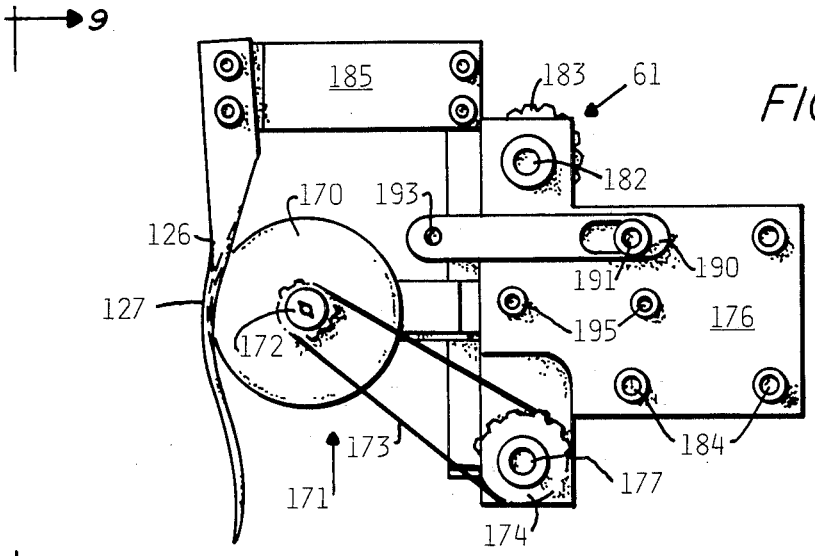
FIG. 8 is a top plan of a cutter assembly and of a hook.
Figure 9:
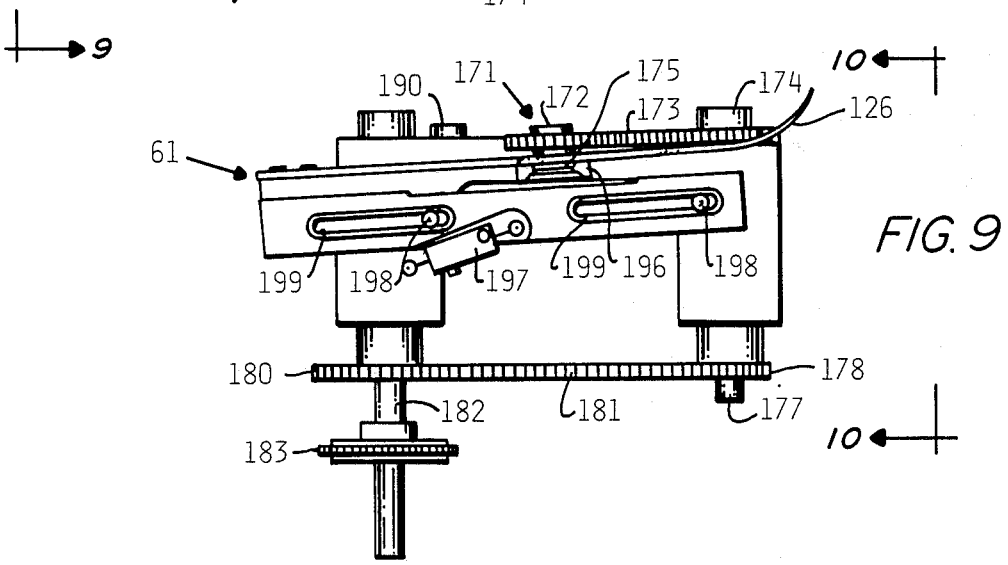
FIG. 9 is a view in front elevation of the cutter assembly of FIG. 8, looking in the direction of the arrows line 9—9 in FIG. 8.
Figure 10:
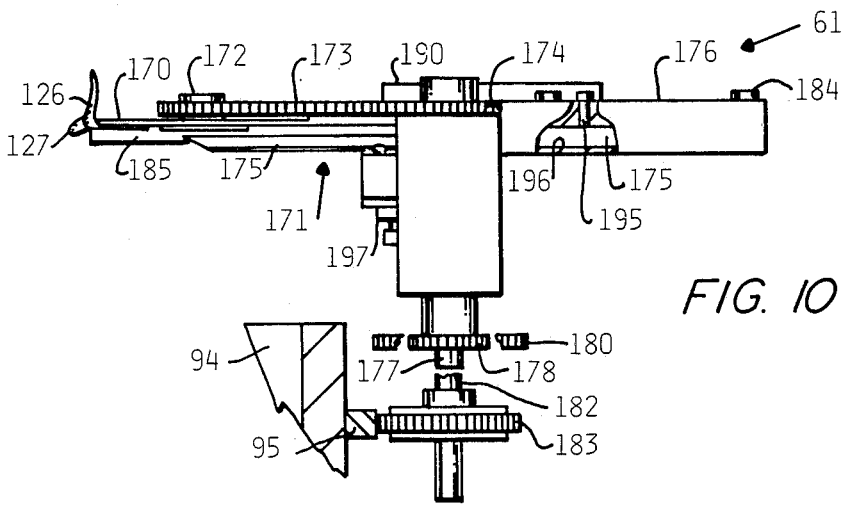
FIG. 10 is a view in side elevation of the cutter assembly of FIGS. 8 and 9, looking in the direction of the arrows 10—10 in FIG. 9. Some portions are broken off or broken away and shown in section, as is a portion of the intermediate ring and its ring gear.

In between each upper pressure blade 132 of one assembly 60, and the lower blade 133 of the adjacent assembly 60 is positioned a cutter assembly 61 (See FIG. 12). The assembly 61 may include a disc blade 170 with a sharp cutting edge therearound. This cutter blade 170 is mounted, as shown in FIGS. 8 to 10, on a keyed assembly 171, which supports the blade 170 for relative rotation. The blade 170 is rigidly secured to a gear member 172. A chain 173 engages this gear member 172 and another gear 174. The assembly 171 includes a strip-like member 175 which is attached to a main support plate 176, which in turn is mounted on the table 91 (FIG. 11).

The gear 174 (FIGS. 9 and 10) is mounted on the upper end of a a shaft 177 on the lower end of which is secured another gear 178. The gear 178 is connected by a chain 181 to a gear 180 that is secured to a shaft 182. The shaft 182 carries another gear 183, which meshes with the toothed ring gear 95, on the non-rotating annular support 94. Thus, the rotation of the table 91 around the stationary member 94 acts to drive the gear 183 and thereby rotate the sharp cutter blade 170.

The main support member 176 is secured to the table's upper surface 92 by several screws 184 (FIG. 8)

and is provided with an extension member 185 at one end (FIGS. 8, 19, and 11), which extends radially inwardly and to which is attached rigidly the hook member 126. Each hook member 126 extends generally along the periphery of the drum 50 and is curved along an arc 127 to provide a desired shape so that the yarn strands 56 can follow a path which will enable the cutter blade 170 to achieve the desired length of pile 34.

Cutting the pile strands (FIGS. 15–17)

In FIG. 15 through 17, a length of jute 31 and a strand of yarn 56 are shown, along with the mandrel 50. In FIG. 15, the hook 126 picks up the strand 56 and guides it along to a point 186, where it is held in place by the lower pressure blade 133. (For clarity some pieces have been left out in this view). A short length 187 of pile is shown here, as are completed pile strands 188 and 189.

In FIG. 16 the strand 56 is held in place at points 186 and 186' by both pressure blades 132 and 133 and is in position around the hook 126, just prior to being cut by the cutter blade 170.

In FIG. 17, are two halves 187*a* and 187*b* of the completed pile strand 187, one above and one below the pressure blade 133. They are shown just after having been cut by the cutter blade 170. A short end 56*a* of the strand 56 is being held in place by the upper pressure blade 132.

The hook 126 is curved along in length in the broad curve 127 to give slack to the strand 56 while its loop 128 is being formed. Then the strand 56 is cut in the center of the loop 128. (See FIGS. 15–17).

As the sequence begins again, the jute 31 is being pulled down by the action of the roller 63, which is being controlled by the motor 120, into a position whereby the lower pressure blade 133, is now holding the strand end 56*a* against the jute 31, and the mandrel 50.

Varying thread density and pile height

The thread density can be varied by rotating the shafts 137 of the pressure blade assemblies 60. For this purpose (See FIGS. 8, 11, and 12), a bar 190 may be rigidly secured by a screw 191 to the main support plate 176 of the cutter blade assembly 61. The bar 190 extends beyond the inner end of the plate 176 to a point above the member 156. A screw 192 is supported at an angle by the bar 190 in a threaded angular opening 193. The outer end of the screw 192 bears against the member 156. Threading the screw 192 forward or back relative to the bar 190 effects rotation of the holder 130 about the shaft 137. Such rotation widens (or narrows) the gap between the upper and lower pressure blades 132 and 133 and thereby the strands 56 will be further apart when the gap is wider (or closer together when the gap is narrower).

Figure 18:
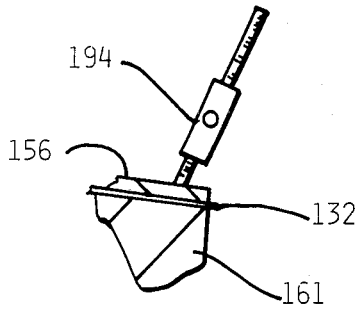
FIG. 18 is a fragmentary view in section along the line 18—18 in FIG. 5 showing a modification of a portion of the structure of FIG. 12.

As shown in FIG. 18 and also in FIG. 5, this adjustment may be made mechanically instead of manually by replacing the screw 192 with a hydraulic cylinder or a solenoid 194, which, as will be seen can be controlled remotely.

The height of the pile can be varied by sliding the hook 126 and by retracting or advancing the cutter blade 170. The hook 126 can be slid to form a bigger loop 128 of thread after loosening set screws 195 (FIGS. 8 and 10–12) that extend through a guide slot 196 (FIGS. 9 and 10), retightening them after the adjustment is made. This can also be done mechanically by a cylinder or solenoid 197 (FIGS. 9 and 10). The cutter blade 170 is retracted or advanced after loosening set screws 198 in slots 199 the main support plate 176. The set screws 198 are also noteworthy for being at different levels to impart the needed 4° tilt, to the cutter blade 126, like the pressure blades as described earlier. It can, alternatively be done (FIG. 9) by the solenoid 197 (or a cylinder).

Figure 19:
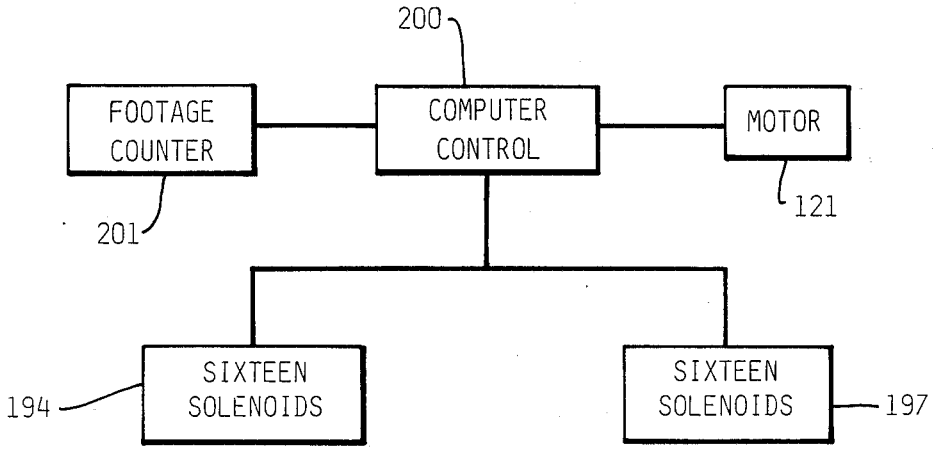
FIG. 19 is a block diagram of a computer control system.

The sixteen cylinders or solenoids 194 and the sixteen cylinders or solenoids 197 may be controlled in a conventional manner by a computer 200 (and suitable circuitry, as shown in FIG. 19). The computer 200 can also control, via the main power drive 121, the speed of the jute 31 along the mandrel 50.

Further, the computer 200 has a footage counter 201 (FIG. 4), so that at a predetermined length of pile fabric, the solenoids 194 and 197 can be actuated, and manufacture to different standards is effected.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A power loom for making carpets, tapestry and the like, when fed by suitable strands of yarn and an adhesively coated jute, including in combination:

a stationary, cylindrical mandrel having a base, an upper end, and a cylindrical outer surface, a rotatable annular table surrounding said mandrel and adjacent to said mandrel's upper end, drive means for rotating said annular table around said mandrel, guide means for guiding each strand of yarn down vertically between said mandrel and said annular table, a continuous circumferential series of substantially identical loom stations mounted in succession on said annular table, each said station having a pressure blade assembly, a guiding hook, and a cutter assembly, and jute feed means for feeding a jute in split cylindrical form downwardly around and with an inner surface against said mandrel, said jute having an adhesively coated outer surface, each said hook comprising means for engaging a series of successive strands passing down from said guide means and at each loom station, feeding them one at a time to a said pressure blade assembly as said annular table rotates, each said pressure blade assembly including pressure means for forcing each strand against said jute and adhering it there to said jute's outer surface, and each said cutter assembly comprising cutting means for severing each said strand at a desired pile height, all as said annular table rotates.

2. The power loom of claim 1, wherein each of said pressure blade assemblies has a sector generally parallel to said mandrel, with an upper freely rotatable disc at one end and a lower freely rotatable disc at the other end, said pressure blade assemblies being overlapped to provide at each station a pair of freely rotatable undriven discs, namely a said upper disc or one said pressure plate assembly and a said lower disc on another overlapped said pressure plate assembly, each said disc engaging each strand, one by one, said pair of discs being spaced apart vertically from each other.

3. The power loom of claim 2 wherein the discs have serrated circumferential edges.

4. The power loom of claim 2 wherein the discs are tilted toward each other, bringing them closest together at a point where they are nearest to the mandrel.

5. The power loom of claim 2 wherein each said cutter assembly comprises a sharp blade located between a said pair of upper and lower discs.

6. The power loom of claim 5 wherein each said cutter blade is rotated by said drive means to cut off said thread at a point midway between said discs, thereby leaving two lengths forming a pile thread.

7. The power loom of claim 6 having position determining means for adjusting the radial position of said cutter blade relative to said mandrel.

8. The power loom of claim 7 wherein said position determining means for all said cutter blades comprises power driven means driven from single control means.

9. The power loom of claim 2 having locating means for each said pressure blade assembly for determining the position of each said disc relative to said mandrel.

10. The power loom of claim 9 having single control means for all said locating means for simultaneous adjustment of all said discs.

11. The power loom of claim 1 including in combination therewith:

a stationary main frame, said mandrel being supported thereby, an intermediate cylindrical ring with a ring gear around its outer surface, in between and spaced laterally from said mandrel and from said table and supported in a stationary position by said main frame, said table surrounding and being spaced from and adjacent to said ring, said table having a flat annular upper surface with inner and outer circular edges, and an inner depending sleeve extending down from its circular inner edge and having a lower edge, and a radially outer surface, and a series of horizontally mounted rollers supported for free rotation by said main frame, engaged by said lower edge of said sleeve, and thereby supporting said table for free rotation.

12. The power loom of claim 11 having a series of vertically mounted rollers supported for free rotation by said main frame in engagement with the outer edge of said table to guide said table when it rotates.

13. The power loom of claim 12 having drive means for rotating said table around said mandrel, said drive means including a motor having a drive shaft with a first gear thereon, a vertical main shaft, said main shaft having second and, third gears thereon, a first chain connecting said first and second gears so that said motor drives said main shaft, a first band engaging said third gear, which is at the upper end of said vertical main shaft and in firm driving contact with the radially outer surface of said sleeve, so as to drive said table.

14. The power loom of claim 1 wherein said guide ring is a stationary, upper, yarn-guide ring supported by said main frame and spaced above said annular assembly and having a multiplicity of guide openings therethrough for guiding each strand of yarn down vertically to the space between said mandrel and said intermediate ring.

15. The power loom of claim 13 having a fourth gear on said main drive shaft, said jute feed means being driven by said motor through said fourth gear.

16. A power loom for making carpets, tapestry and the like, when fed by suitable strands of yarn and an adhesively coated jute, including in combination:

a stationary, cylindrical mandrel having a base, an upper end, and a cylindrical outer surface, a rotatable annular table surrounding said mandrel and adjacent to said mandrel's upper end, drive means for rotating said annular table around said mandrel, guide means for guiding each strand of yarn down vertically between said mandrel and said annular table, a continuous circumferential series of substantially identical loom stations mounted in succession on said annular table, each said station having a pressure blade assembly, a guiding hook, and a cutter assembly, and jute feed means for feeding a jute in split cylindrical form downwardly around and with an inner surface against said mandrel, said jute having an adhesively coated outer surface, each said hook comprising means for engaging a series of successive strands passing down from said guide means and at each loom station, feeding them one at a time to a said pressure blade assembly as said annular table rotates, each said pressure blade assembly including pressure means for forcing each strand against said jute and adhering it there to said jute's outer surface, each said cutter assembly comprising cutting means for severing each said strand at a desired pile height, all as said annular table rotates, each of said pressure blade assemblies having a sector generally parallel to said mandrel, with an upper freely rotatable disc at one end and a lower freely rotatable disc at the other end, said pressure blade assemblies being overlapped to provide at each station a pair of freely rotatable undriven discs, namely a said upper disc or one said pressure plate assembly and a said lower disc on another overlapped said pressure plate assembly, each said disc engaging each strand, one by one, said pair of discs being spaced apart vertically from each other.

17. The power loom of claim 16 wherein the discs are tilted toward each other, bringing them closest together at a point where they are nearest to the mandrel, each said cutter assembly comprising a sharp blade located between a said pair of upper and lower discs and rotated by said drive means to cut off said thread at a point midway between said discs, thereby leaving two lengths forming a pile thread.

18. The power loom of claim 16 including in combination therewith:

a stationary main frame, said mandrel being supported thereby, an intermediate cylindrical ring with a ring gear around its outer surface, in between and spaced laterally from said mandrel and from said table and supported in a stationary position by said main frame, said table surrounding and being spaced from and adjacent to said ring, said table having a flat annular upper surface with inner and outer circular edges, and an inner depending sleeve extending down from its circular inner edge and having a lower edge, and a radially outer surface, and a series of horizontally mounted rollers supported for free rotation by said main frame, engaged by said lower edge of said sleeve, and thereby supporting said table for free rotation.

19. The power loom of claim 18 having drive means for rotating said table around said mandrel, said drive means including a motor having a drive shaft with a first gear thereon, a vertical main shaft, said main shaft having second and, third gears thereon, a first chain connecting said first and second gears so that said motor drives said main shaft, a first band engaging said third gear, which is at the upper end of said vertical main shaft and in firm driving contact with the radially outer surface of said sleeve, so as to drive said table.

20. A power loom for making carpets, tapestry and the like, when fed by suitable strands of yarn and an adhesively coated jute strip, including in combination:

a stationary main frame, a stationary, cylindrical mandrel supported by said main frame and having a base, an upper end, and a cylindrical outer surface, an intermediate stationary cylindrical ring supported by said main frame and surrounding said mandrel at a space therefrom, with a ring gear around its outer surface, a rotatable annular table surrounding and spaced from and adjacent to said ring near the upper end of said mandrel, said table having a flat annular upper surface with inner and outer circular edges, and an inner depending sleeve extending down at its circular inner edge and having a lower edge and a radially outer surface, a series of horizontally mounted rollers supported for free rotation by said main frame, engaged by said lower edge of said sleeve and thereby supporting said table for free rotation, drive means for rotating said table around said mandrel, said drive means including a motor near said base having a drive shaft with a first gear thereon, a vertical main shaft, said main shaft having second, third, and fourthe gears thereon, a first chain connecting said first and second gears so that said motor drives said main shaft, a first band engaging said third gear, which is at the upper end of said vertical main shaft, said band being in firm driving contact with the radially outer surface of said sleeve, so as to drive said table, a stationary, upper, yarn-guide ring supported by said main frame and spaced above said annular table and having a multiplicity of guide openings therethrough for guiding each strand of yarn down vertically to the space between said mandrel and said intermediate ring, a continuous circumferential series of loom stations mounted in succession on said table, each said station having a pressure blade assembly, a guiding hook, and a cutter assembly, said pressure blade assemblies each having a sector generally parallel to said mandrel, with an upper rotatable disc at one end and a lower rotatable disc at the other end, said assemblies being overlapped to provide at each station a pair of freely rotatable undriven discs, namely a said upper disc on one said pressure blade assembly and a said lower disc on another overlapped said pressure blade assembly, each said disc engaging each strands, one by one, said pair of discs being spaced apart vertically from each other, and between which said cutter assembly provides a sharp disc blade rotated by a drive train driven by said ring gear, to cut off said thread at a point midway between said discs, thereby leaving two lengths forming a pile thread, each said hook means engaging the strands before they are cut and guiding them to said discs and to the cutting blade, and jute feed means driven by said motor through said fourth gear, for feeding a flat jute strip in split cylindrical form downwardly around said anvil, said jute strip having an adhesively coated outer surface to which said pile thread is affixed by said pressure blade discs, whereby said hook engages a plurality of successive strands passing down from said yarn-guide ring and feeds them one at a time a locus between two said pressure blade discs as said annular assembly rotates, said pressure blade discs forcing each strand against said jute and adhering it there to said jute's outer surface, said cutter blade cutting off said strand at the desired pile height, all as said annular assembly rotates.

21. The power loom of claim 20 having a series of vertically mounted rollers supported for free rotation by said main frame in engagement with the outer edge of said table to guide said table when it rotates.

22. The power loom of claim 20 wherein the discs have serrated circumferential edges.

23. The power loom of claim 20 wherein the discs are tilted toward each other, bringing them closest together at a point where they are nearest the mandrel, the cutter disc blades being located between the pair of upper and lower discs.

24. The power loom of claim 23 having position determining means for adjusting the radial position of said cutter blade relative to said mandrel, said position determining means for all said cutter blades comprising power driven means driven from single control means.

25. The power loom of claim 24 having locating means for each said pressure blade assembly for determining the position of each said disc relative to said mandrel, said single control means simultaneously adjusting all said pressure blade discs.

26. The power loom of claim 20 having a fourth gear on said main drive shaft, said jute feed means being driven by said motor through said fourth gear.

27. A power loom for making carpets, tapestry and the like, when fed by suitable strands of yarn and an adhesively coated jute, including in combination:

jute roll support means for supporting a roll of jute so that it can unroll freely, first jute guide means for guiding unrolled jute as a continuous flat sheet of jute from said roll along a feed path, adhesive spray means in said path for spraying one surface of said jute with adhesive.

a stationary, cylindrical mandrel having a base, an upper end, and a cylindrical outer surface, first jute feed means for feeding said jute in split cylindrical form downwardly from said feed path around and with an inner surface against said mandrel, said jute having its adhesively coated surface facing outwardly, a rotatable annular table surrounding said mandrel and adjacent to said mandrel's upper end, drive means for rotating said annular table around said mandrel, guide means for guiding each strand of yarn down vertically between said mandrel and said annular table, a continuous circumferential series of substantially identical loom stations mounted in succession on said annular table, each said station having a pressure blade assembly, a guiding hook, and a cutter assembly, and each said hook comprises means for engaging a series of successive strands passing down from said guide means and at each loom station feeding them one at a time to a said pressure blade assembly as said annular table rotates, each said pressure blade assembly including pressure means for forcing each strand against said jute and adhering it there to said jute's outer surface, and each said cutter assembly comprising cutting means for severing each said strand at a desired pile height, all as said annular table rotates, to apply a pile to the adhesively coated surface, jute spreading means below said mandrel for opening said jute from its split cylindrical form into a flat horizontal sheet form with said pile facing downwardly, second jute guide means for guiding the spread flat sheet of said jute along an output path, drying means in said output path for drying the adhesive and thereby securing the attachment of said pile to said jute, leaving a distal end of said pile projecting from said jute, pile trimming means following said drying means in said output path, for cutting off the distal end of said pile to an even height, and jute cut-off means on said output path following said pile trimming means for cutting off a selected length of the pile-coated jute.

28. The power loom of claim 27 having second adhesive spray means located along said output path prior to said drying means for spraying adhesive on the non-pile side of said jute.

29. The power loom of claim 27 wherein said first jute feed means, said drive means, and said second jute guide means are all driven by a common prime power drive means.

30. A method for making carpets, tapestry and the like, by combining a long strip of jute with suitable strands of yarn, including the steps of:

coating one surface of said jute with an adhesive, forming said jute into a split cylinder with the adhesive coated surface facing outwardly, supporting the non-adhesive side of said jute, rotating an annular table continuously around said jute, while advancing said jute perpendicularly to said table, said table having a continuous circumferential series of substantially identical loom stations mounted in succession therearound on said annular table, each said station having a pressure plate assembly, a guiding hook, and a cutter assembly, guiding a multiplicity of yarn strands in between said jute and said annular table, engaging each said strand with a said hook and feeding the strands one at a time at each said station to a said pressure blade assembly while said annular table rotates, forcing each strand at each said pressure blade assembly against said jute and adhering it there to said jute's outer surface, and cutting off said strand by said cutter blade assembly at a desired pile height, all while rotating said annular table.

31. The method of claim 30 wherein said cutting step includes driving a disc blade of said cutter blade assembly to do said cutting.

32. A method for making carpets, tapestry and the like, by combining a long strip of jute with suitable strands of yarn, including the steps of:

supporting a roll of jute so that it unrolls freely, guiding the unrolled jute as a continuous flat sheet of jute from said roll along a feed path, coating one surface of said jute with an adhesive, forming said jute into a split cylinder with the adhesive coated surface facing outwardly, supporting the non-adhesive side of said jute, rotating an annular table continuously around said jute, while advancing said jute perpendicularly to said table, said table having a continuous circumferential series of substantially identical loom stations mounted in succession therearound on said annular table, each said station having a pressure plate assembly, a guiding hook, and a cutter assembly, guiding a multiplicity of yarn strands in between said jute and said annular table, engaging each said strand with a said hook and feeding the strands one at a time at each said station to a said pressure blade assembly while said annular table rotates, forcing each strand at each said pressure blade assembly against said jute and adhering it there to said jute's outer surface, and cutting off said strand by said cutter blade assembly at a desired pile height, all while rotating said annular table, opening said jute from its split cylindrical form into a flat horizontal sheet form with said pile facing downwardly, guiding the spread flat sheet of said jute along an output path, drying the adhesive and thereby securing the attachment of said pile to said jute, leaving a distal end of said pile projecting from said jute, trimming off the distal end of said pile to an uneven height, and cutting off a selected length of the pile-coated jute.

33. The method of claim 32 wherein said coating step comprises spraying adhesive on one side of said jute.

34. The method of claim 32 having a step of applying adhesive to the non-pile side of said jute before said drying step and after said opening step.

* * * * *